United States Patent [19]

Addison

[11] Patent Number: 4,656,858

[45] Date of Patent: Apr. 14, 1987

[54] ROLL FORMING APPARATUS

[75] Inventor: Gordon D. Addison, Birmingham, England

[73] Assignee: Gutterfast Limited, Surrey, England

[21] Appl. No.: 623,225

[22] Filed: Jun. 21, 1984

[30] Foreign Application Priority Data

Jun. 21, 1983 [GB] United Kingdom ..... 8316864

[51] Int. Cl.[4] ..... B21D 5/14

[52] U.S. Cl. ..... 72/181; 72/176; 493/178; 493/438

[58] Field of Search ..... 72/176, 181, 178, 179; 493/438–440, 446, 461, 178, 447; 53/230; 198/836

[56] References Cited

U.S. PATENT DOCUMENTS

| | | | |
|---|---|---|---|
| 683,996 | 10/1901 | Schmeltzer | 72/181 |
| 862,161 | 8/1907 | Hollett | 493/178 |
| 1,673,787 | 6/1928 | Frahm et al. | 72/181 |
| 2,135,880 | 11/1938 | Waldman et al. | 493/440 |
| 2,753,770 | 7/1956 | Chapman | 493/178 |
| 2,912,038 | 11/1959 | Harper | 72/178 |
| 3,297,315 | 1/1967 | Kanz | 493/461 |
| 3,462,989 | 8/1969 | Fischer, Jr. | 72/181 |
| 3,527,336 | 9/1970 | Johnston | 198/836 |
| 3,529,461 | 9/1970 | Knudson | 72/181 |
| 3,656,416 | 4/1972 | Baum | 493/438 |
| 4,187,769 | 2/1980 | Bullock | 493/438 |

FOREIGN PATENT DOCUMENTS

| | | | |
|---|---|---|---|
| 749721 | 12/1944 | Fed. Rep. of Germany | 72/178 |
| 940582 | 3/1956 | Fed. Rep. of Germany | 72/178 |

*Primary Examiner*—Daniel C. Crane

*Attorney, Agent, or Firm*—Wenderoth, Lind & Ponack

[57] ABSTRACT

A forming apparatus for shaping a workpiece made from malleable metal strip driven through the apparatus comprises a main frame on which are mounted driven bottom rollers for driving and supporting the workpiece through the apparatus and top rollers pressing the strip against the bottom rollers. The top rollers are mounted on side sub-frames which are traversible towards and away from the longitudinal center-line of the apparatus and which carry forming tools. The sub-frame may carry forming rollers mounted in cylindrical carriers which are themselves rotatably mounted end to end in support tubes extending parallel to said center-line and are rotationally adjustable independently of each other, for example to allow the amount of angular deformation of the strip to be adjusted without necessarily changing the forming tools. Bars provided to effect bending may be readily adjusted for size variation.

9 Claims, 20 Drawing Figures

ROLL FORMING APPARATUS

BACKGROUND OF THE INVENTION

This invention relates to roll forming apparatus and has a particularly useful but not exclusive application in the continuous forming of channel-section components, such as gutters, from metal strip.

SUMMARY OF THE INVENTION

According to this invention in one aspect there is provided a forming apparatus for shaping a workpiece made from malleable metal strip moved lengthwise of itself through the apparatus, which apparatus comprises a main frame carrying means for supporting and/or driving the workpiece through the apparatus, a sub-frame at at least one side of the longitudinal centre line of the apparatus which sub-frame carries forming tools for shaping the workpiece, and means for adjusting the position of the sub-frame towards and away from the longitudinal centre line of the apparatus.

According to this invention in another aspect there is provided roll forming apparatus comprising means for supporting a strip of sheet metal and driving said strip along a straight path which means includes a plurality of rollers spaced along said path, the corresponding side edges of which rollers engage one face of the strip to nip the strip and together define a bending axis for the strip, a set of bars arranged end to end and extending lengthwise of said path, which bars are adapted to engage the other face of the strip at a location offset laterally from said axis and are angled so as progressively to bend the strip about said axis as the strip moves along said path, and means whereby the angular portions of opposite ends of the bars about said axis can be adjusted independently of each other. In one such construction the downstream end of each bar is connected by screw means to a support structure, the screw means being adjustable to vary the distance of the end of the bar from the structure thereby to alter the angular position of the end of the bar about said axis. Conveniently, where a plurality of bars are arranged end to end along said path, successive bars along said path have their adjoining ends interconnected by a flexible connection so as to avoid the formation of abutment surfaces for the leading end of the strip at the junctions of the bars. In some constructions according to the invention, where two or more bars are arranged in succession along said path, each pair of mutually adjoining ends of successive bars and the downstream end of the last bar of the succession are each angularly adjustable about said axis by means comprising an arm which is mounted for swivelling movement about said axis and to which said downstream end or, as the case may be said mutually adjoining ends, are connected, said members being movable towards said axis by means which operates all of said bars such that the arm furthest upstream is swung progressively from an initial angle relative to the plane of the strip to a maximum angle and that the next arm downstream then moves progressively from said maximum angle to a greater angle and so on for successive arms.

According to a preferred feature of the invention, said rollers and bars and the adjustment means for altering the angular positions of the bars constitute a sub-assembly which is adjustably movable laterally with respect to said straight path.

The invention also provides roll forming apparatus comprising a first member, the internal surface of which provides a bearing surface of circular cylindrical form interrupted by an opening extending axially along the member, a support structure carrying said first member, a carrier disposed within the first member and adjustably rotatable in engagement with said bearing surface, a forming roller rotatably mounted in the carrier in a manner to nip a marginal portion of a strip projecting into the first member through said opening against either a second roller or a fixed element mounted in the carrier, the arrangement being such that the surface of the first roller facing said opening extends radially with respect to said bearing surface and such that the first roller is wholly within the sector of the carrier defined by said surface of the first roller and the nip.

Preferably the angular position of the carrier about the axis of said bearing surface is adjustable relative to the first member. Preferably also the angular position of the first member about the axis of said bearing surface is adjustable relative to the support structure.

The invention further provides roll forming apparatus comprising means for supporting a strip of stiff but malleable sheet material and driving said strip along a straight path, which means includes a plurality of roll-forming means each as described in the last but one preceding paragraph, which roll forming means are spaced apart lengthwise of said path for operating in succession on a marginal portion of the strip and so disposed that the axes of their respective bearing surfaces are colinear and parallel to said path, said plurality of roll-forming means constituting part of a sub-assembly which is adjustably movable as a unit towards and away from the longitudinal center-line of said path. Preferably, said plurality of roll-forming means have a common open-ended first member in which all of the carriers are disposed.

BRIEF DESCRIPTION OF THE INVENTION

The invention will now be described in more detail with reference to the accompanying drawings in which.

DETAILED DESCRIPTION

Figure 1:
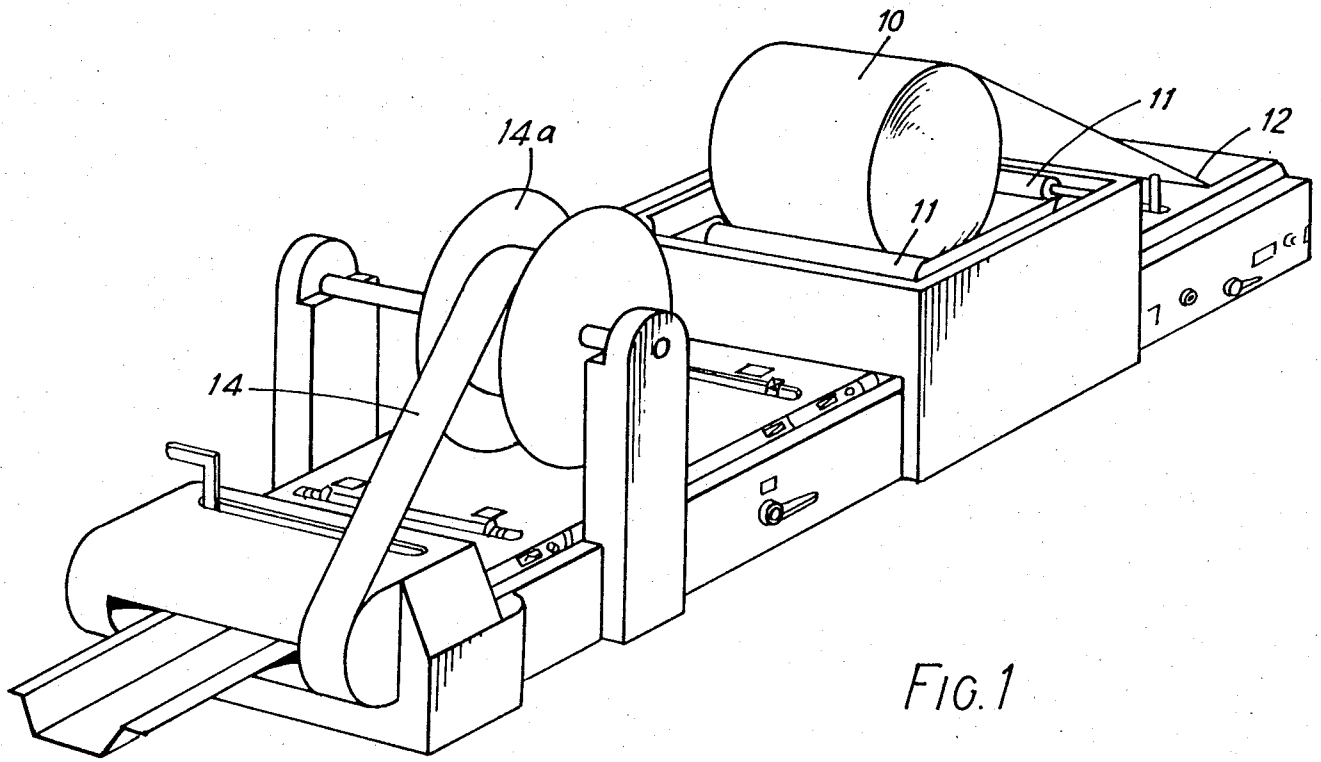
FIG. 1 is a general perspective view of a roll forming machine embodying the invention.

The machine shown in the drawings is intended primarily to produce continuous lengths of symmetrical or asymmetrical channel section components, such as gutters, from metal strip, for example aluminium alloy strip.

A coil 10 of the strip is supported on parallel rollers 11 on top of the machine and the leading end of the strip is led into a slot 12 at the righthand end of the machine as it is shown in FIG. 1 and is fed thence to the left-hand end of the machine where it is shown emerging in the form of a channel section section. The machine incorporates near the inlet slot a slitting cutter (not shown) the position of which is adjustable transversely of the path of movement of the strip to trim to a desired width. The part 14 of the strip which is cut off is fed through the machine and is re-wound on a suitably powered spool 14*a* mounted near the outlet end of the machine.

The initial position of the coil is such that the part 16 of the strip which is to be roll formed is disposed in a pre-selected position relative to the lengthwise centre-line of the machine.

In its passage through the machine the strip is supported on a succession of bottom rollers 15 which are mounted in bearings on the fixed frame 13 of the machine and which carry sprockets 17 at their left hand ends as viewed in the drawings, the sprockets being driven by an electric motor through a chain drive.

Figure 2:
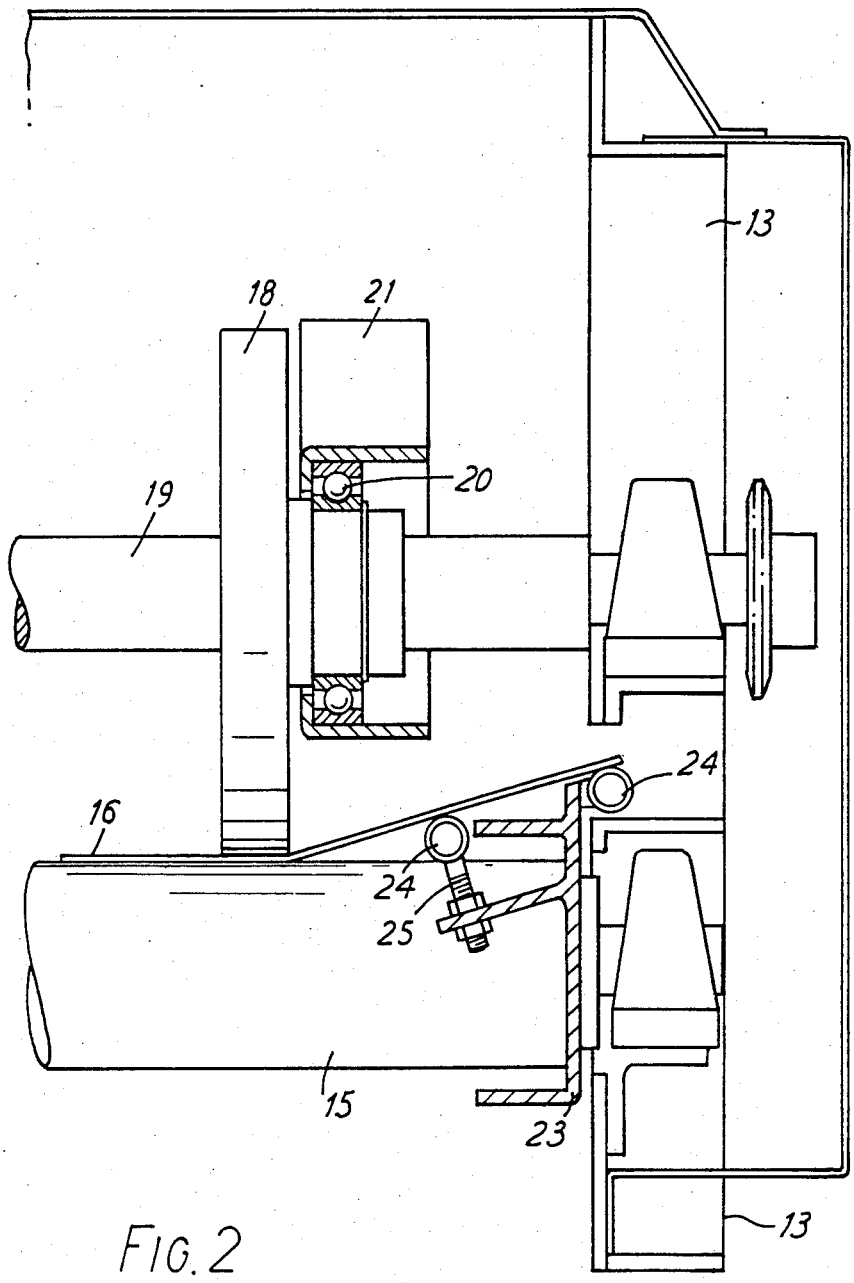
FIGS. 2 to 7 are respectively half sectional diagrammatic views at successive roll forming stations in the machine of FIG. 1.

At each side of the center line of the machine a sub-frame is mounted. The two sub-frames are mounted on the fixed frame 13 and are movable bodily independently of each other towards and away from the lengthwise centre-line of the machine and for adjustment purposes carry roll forming means at each of Stations Nos. 1 to 6 along the path of the strip through the machine. To provide for the adjustment the sub-frame at each side of the machine is mounted on a series of transversely-extending screw-threaded shafts 22 (see, for example, FIG. 4) each of which carries a chain sprocket (not shown), all the sprockets at each side being interconnected by a chain so that the entire subframe at that side and the roll-forming means which it supports move as a unit. One of these shafts 22 (that in FIG. 4 in the present instance) has a squared outer end 22*a* whereby the position of the unit is adjustable. In this way alignment problems during the setting of the machine are alleviated, since a common lengthwise datum line is provided. In the following description, the roll forming means at one side of the machine are described, the means at the other side being a mirror image. The first forming section is illustrated in FIG. 2 to which reference is now made. At this Station No. 1, of which the right hand side is shown, the strip 16 supported on the rollers 15 is pressed down on one of the rollers 15 by a top roll 18 keyed to a transverse drive shaft 19 which is in turn mounted in the fixed frame of the machine. The left hand end of the drive shaft carries a drive sprocket driven by a chain from a main drive motor. The top roll 18 is mounted in bearings 20 in a frame member 21 which constitutes part of the transversely movable sub-frame described above. The key connection ensures that roll 18 is driven whatever its position along the shaft 19.

At the side of the top roll 18 remote from the center-line of the machine, a second member 23 of the sub-frame provides an intermediate support for two tubular bars 24 which extend generally parallel to each other. The bars are mounted on the sub-frame member 23 through screw-threaded studs 25 enabling the height of the bars to be adjusted. The upstream ends (not shown) of the two bars are fixed to the sub-frame member 23 so that their upper edges are substantially flush with the top edges of the supporting rollers 15, but at Station No. 1 shown in FIG. 2, the bars are arranged such that a line drawn from the outer edge of the top roll 18 where it forms a nip with the co-operating support roller 15 and extending tangentially over the two bars 24 forms an angle of 15° with the horizontal i.e. with the plane of the strip 16. Thus as the strip is drawn towards Station No. 1 the edge portion of the strip projecting beyond the outer edge of the top roll 18 is progressively bent upwards to an angle of 15°.

Figure 3:
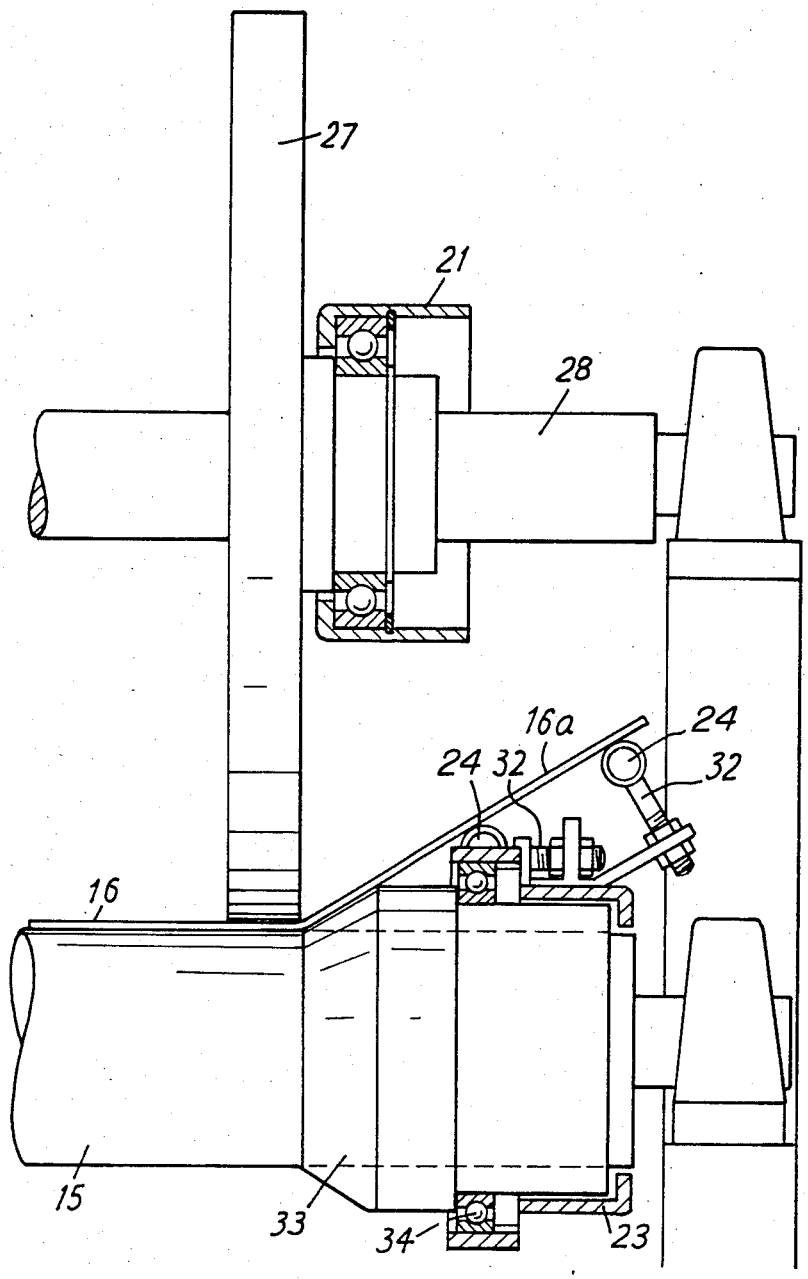

From the first station, the strip is drawn towards the second Station No. 2, which is illustrated in FIG. 3. At Station No. 2 of which the right hand side is shown, a second driven top roll 27 is mounted in the sub-frame member 21 in exact alignment with the top roll 18 in a direction parallel to the center-line of the machine and similarly slidably keyed to a drive shaft 28 carrying a sprocket driven by the same chain as shaft 19. The sub-frame 23 provides a further support adjacent roll 27 for the tubular bars 24. The bars 24 are mounted on the sub-frame 23 through screw-threaded rods 32 which are adjusted so that a line extending from the outer edge of the top roll 27 tangentially of the two bars 24 makes an angle of 30° with the horizontal. Between Stations Nos. 1 and 2, the bars 24 thus progressively increase to 30° the angle of the marginal portion 16a of the strip 16 with respect to the horizontal. The bottom support roll 15 at Station No. 2 is encircled by a sleeve member 33 carried in bearings 34 in the sub-frame member 23 and having its edge adjoining the top roll 27 chamfered at an angle of 30°, and this member serves to form a sharp bend along a bend axis between the marginal and central parts of the strip 16.

Figure 4:
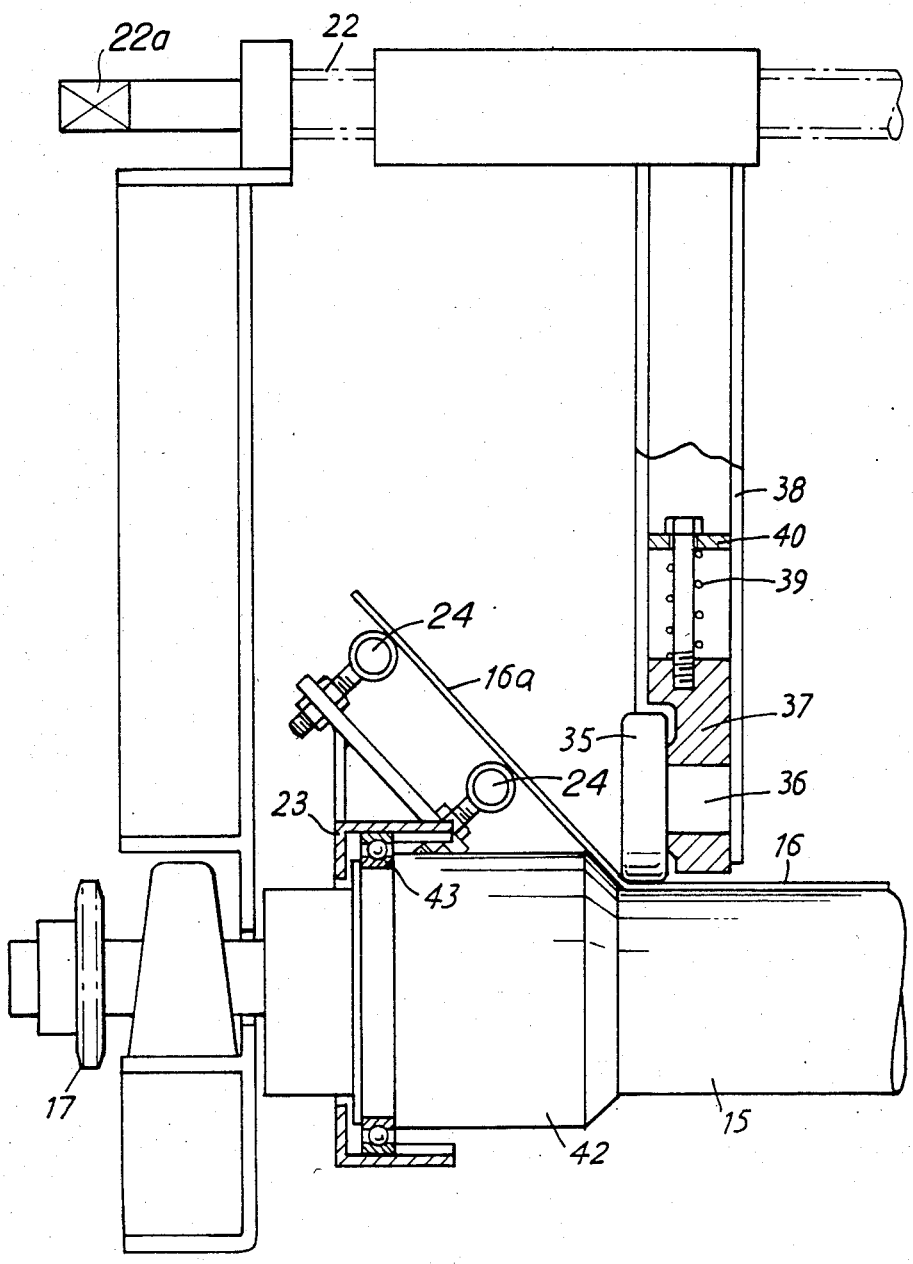
Figure 8:
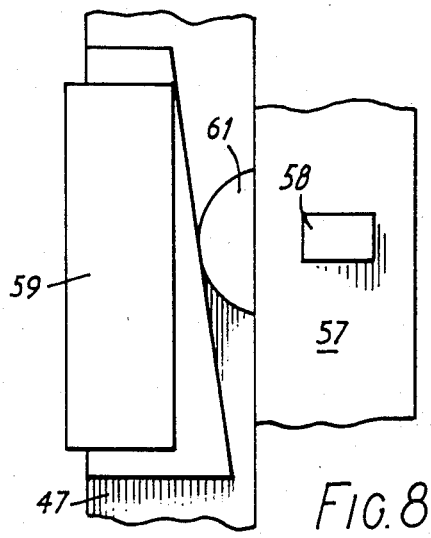
FIG. 8 is a fragmentary plan view in the direction of the arrows 8 in FIG. 5.

From Station No. 2, the strip passes the Station No. 3 which is illustrated in FIG. 4 to which reference is now made. At Station No. 3 of which the left hand side is shown, the central portion of the strip 16 is pressed down against a bottom support roller 15 by a small diameter free running roller 35, the outer edge of which is exactly aligned with the outer edges of the driven top rolls 18 and 27 at Stations 1 and 2. The roller 35 is mounted on a stub shaft 36 carried by a block 37 located in a vertical slideway in an upright guide member 38 which is in turn secured to a horizontal tubular member incorporating a nut engaged on one of the transverse rotary screw-threaded shafts 22, so as to move towards and away from the centre-line of the machine with the other parts of the left hand subframe assembly. The roller 35 is pressed downward into engagement with the strip by a compression spring 39 seated against a fixed abutment piece 40 extending across the slideway. The downstream ends of the two tubular bars 24 are mounted on the sub-frame member 23 and have screw-threaded screws whereby the positions of the bars are adjustable relative to the frame member. The bars 24 are arranged so that at Station No. 3 a common tangent to the upper surfaces of the bars forms at an angle of 45° with the point at which the roller 35 engages the strip. The support roller 15 directly beneath the roller 35 is encircled by a sleeve 42 mounted in bearings 43 in the sub-frame members 23, and the inner end of the sleeve is chamfered at an angle of 45° to its central axis. Acting in co-operation with the roller 35, the sleeve serves to increase to 45° the angle of bend between the marginal and main portions of the strip 16.

As previously stated the sub-assemblies at opposite sides of the center-line of the machine are mirror images of each other. The machine as thus far dexcribed is arranged to incline one or both of the marginal portions of the strip upwardly at an angle of 45°, and in this instance the angle is fixed at this minimum value. However, any other minimum angle may be formed by appropriately inclined bars.

Figure 5:
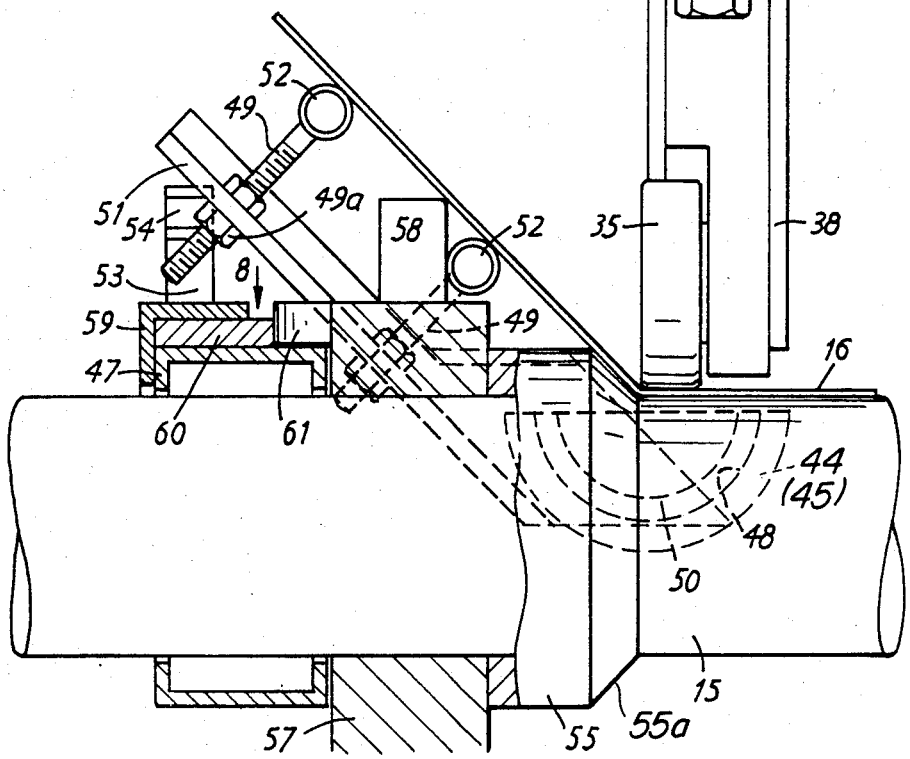

From Station No. 3, the strip passes through Stations Nos. 4, 5 and 6 in succession which increases the angle between the marginal part of the strip in the horizontal in successive steps of 15°, and the mechanisms provided at these stations are similar to each other and are operated in unison. FIG. 5 shows the mechanism at Station No. 6 by way of example. The mechanism includes a plate 44 mounted on a longitudinal member 47 of the transversely movable subassembly. This plate extends transversely of the machine and has its upper edge disposed horizontally just beneath the bottom face of the strip 16 at a location just upstream of the bottom roller 15 at Station No. 5 and has in its downstream face an arcuate groove 48 centred on a bend axis which corresponds to the line of the outer edges of the top rolls 18, 27, 35, i.e. substantially on the line about which the marginal portion is bent or folded, and a second plate 45 is disposed in face to face contact with the first plate 44 and has an arcuately extending rib 50 which is a sliding fit in the groove 48 in the first plate. The movable second plates 45 are held in engagement with their associated first plates by struts which extend between the back face of the first plate 44 of one station and the back face of the movable second plate 45 at the next adjacent station. An arm 51 is secured to the rear face of the second plate and in turn has secured to it through screw-threaded bolts 49 adjustable by means of nuts 49*a* relative to the arm 51 the radially spaced downstream ends of two further tubular bars 52 the upstream ends of which are in flexible spigoted engagement with the downstream ends of the bars 24 at Station No. 3. For this purpose, an intermediate spigot member (not shown) made from a suitably tough but resilient plastics or rubber material is engaged in the adjoining ends of the bars so as to avoid the formation of any abutment surface which might be struck by the leading edge of the strip 16. A sleeve 55 is disposed about the cylindrical bottom driven roll 15 and is slidable along the roll with the transversely movable subassembly, and has its leading edge 55*a* chamfered at increasing angles at Stations Nos. 4 and 5 but at right angles to its axis of rotation at Station No. 6. A bearing is disposed between the outer surface of the sleeve and an aperture in a slide such as an elongate actuating member 57, which extends about the sleeve and about the corresponding sleeves at Stations Nos. 5 and 6. An abutment member such as a rigid upstanding post 58, is mounted on the actuating member, and on movement of the actuating member 57 towards and away from the center-line of the machine engages the lower of the two bars 52 and serves to pivot the arm and bars about the center of curvature of the arcuate groove 48 in the first plate. The inward and outward movement of the elongate actuating member 57 is controlled by a rack and pinion mechanism comprising a rack 53 which extends lengthwise of the machine past Stations Nos. 4, 5 and 6, and the transversely extending pinion 54 of which is mounted on a shaft rotatable by means of a control lever (not shown) on the front of the machine. At each of Stations Nos. 4, 5 and 6 a short angle section member 59 of the transversely movable sub-assembly to form with the top of the member 47 respective slots in which three wedge elements 60 are respectively engaged for sliding movement lengthwise of the machine. The three wedge elements are fixed, one at each of the three stations, to the underside of the rack and have a longitudinally extending base parallel to the center line of the machine and in contact with the angle member 5° and a cam surface, such as an inclined face, in contact with a follower roller 61 mounted on the actuating member 57. The wedge faces of the three first wedge elements 60 are inclined at the same angle inwardly towards the longitudinal center line of the machine but have differing effective lengths. Thus the wedge face of the first wedge element at Station No. 4 has a lengthwise extent sufficient to move the arm 51 at that station into a position in which it is inclined at 45° to the horizontal, and the remainder of the length of the wedge element is parallel to the base of the wedge so as to form a dwell. The wedge face of the first wedge element 60 at Station No. 5 has a length sufficient to move the arm at Station No. 5 into a position in which the bars at that station will bend the marginal portion of the strip up at an angle of /5°, and the remainder of the length of that wedge element is then parallel to its base so as to form a dwell. The wedge face of the first wedge element 61 at Station No. 6 has a length such as to cause the downstream ends of the bars at Station No. 6 to bend the marginal portion of the strip up at an angle of 90°. It will thus be understood that angles of bending of the marginal portion of the strip in the range 45° to 60° are carried out at Station No. 4. If the angle is from 60° to 75° the first 15° is carried out at Station No. 4, the bending from 60° to 75° is carried out at Station 5 and the remainder is carried out at Station No. 6.

The angle of the chamfered leading edge 55*a* of sleeve 55 of the station which completes the formation may be matched to the desired final angle at which the marginal portion of the strip is to be set.

The top roller at each of Stations 4 to 6 is a roller 35 adjustably mounted in a similar way to that at Station No. 7.

Figure 6:
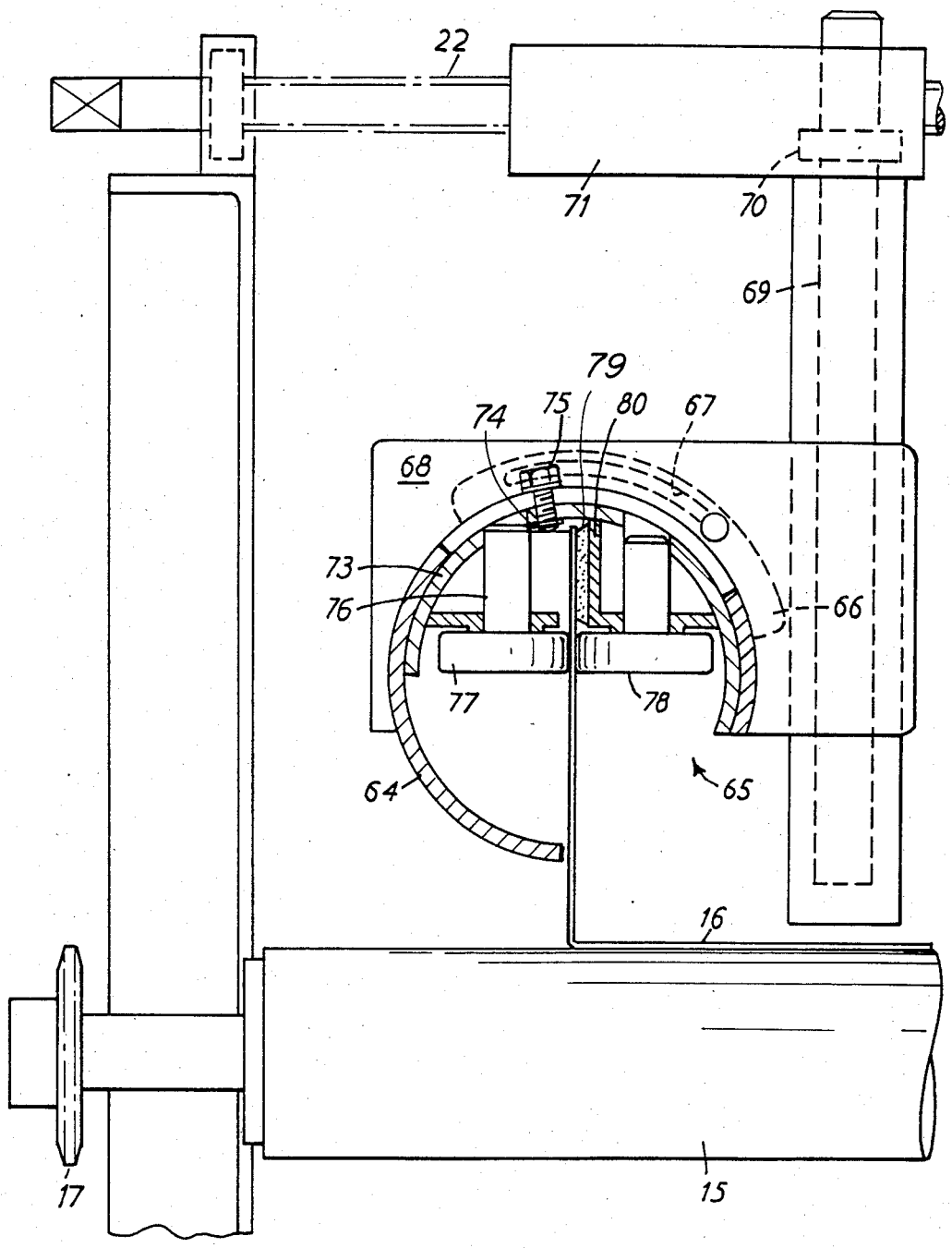

From Station No. 6 the strip continues to Station No. 7 which comprises a 4-stage mechanism illustrated in FIG. 6 at which the edge part of the upturned marginal portion of the strip can be bent inward or outward as desired by an angle of up to 90° in four successive 22½° steps. The apparatus at Station 7 comprises a support tube 64 of circular cross-section but having its periphery interrupted to form a wide slot 65 through which the upstanding marginal portion 16*a* of the strip projects into the interior of the support tube. The support tube has axially spaced flanges 66 on its radially outer surface and bolts extending through arcuate slots 67 in the flanges secure the tube to two laterally extending brackets 68 and nuts welded to the brackets are engaged on vertical screw-threaded shafts 69 rotatably mounted in bearings 70 carried by sleeves 71 respectively mounted on transversely extending screw-threaded shafts 22. Each sleeve 71 incorporates a nut engaged on the associated shaft 22 so that the brackets 68 constitute part of the transversely movable subframe. Rotation of the vertical screw-threaded shafts 69 is employed to adjust the vertical height of the support tube above the bottom rolls 15.

At each of the four stages, a part cylindrical carrier 73 is mounted within the support tube 64 and its external diameter is such that the support tube provides a bearing surface for rotational movement of the carrier. The carrier has a nut 74 welded to its internal surface, and a bolt 75 extends through a circumferentially extending slot in the support tube and through an aperture in the carrier into engagement with the nut so that the rotational position of the carrier relative to the support tube can be adjusted. The carrier supports within it two parallel spindles 76 on which are respectively mounted two rollers 77, 78 which pinch the upstanding marginal portion of the strip between them. The rollers have axes of rotation which extend in a plane which is perpendicular to the central axis of the support tube. The bottom faces of the two rollers extend in a diametrical plane of the carrier and support tube and meet on the longitudinal axis of the tube 64 so as to define the point at which the upstanding marginal portion of the strip will be bent. The height at this point is adjustable by adjusting the height of the brackets 68 along the vertical screw-threaded shafts 69. Since the slots 67 are centered on the central axis of the tube 64, the rotational position of the support tube relative to the brackets can be adjusted to enable the position of the opening 65 in the support tube to be altered if necessary to adjust the position at which the marginal portion of the strip projects into the support tube for engagement by the rolls.

Also mounted in the carrier is a pad 79 formed from a suitable plastics material, e.g. a phenolic resin, the pad being attached to one limb of an angle section member 80 welded to the internal surface of the carrier. The pad assists in supporting the edge part of the strip during the forming operation. It will be seen that if the edge part of the strip is to be bent through 90°, the four stages at Station No. 7 will be set to bend the edge part in successive steps of substantially 22½°. The four carriers will be set in positions 22½°, 45°, 67½° and 90° from that shown, the direction of setting being selected according to the direction in which the edge part is to be bent.

Figure 7:
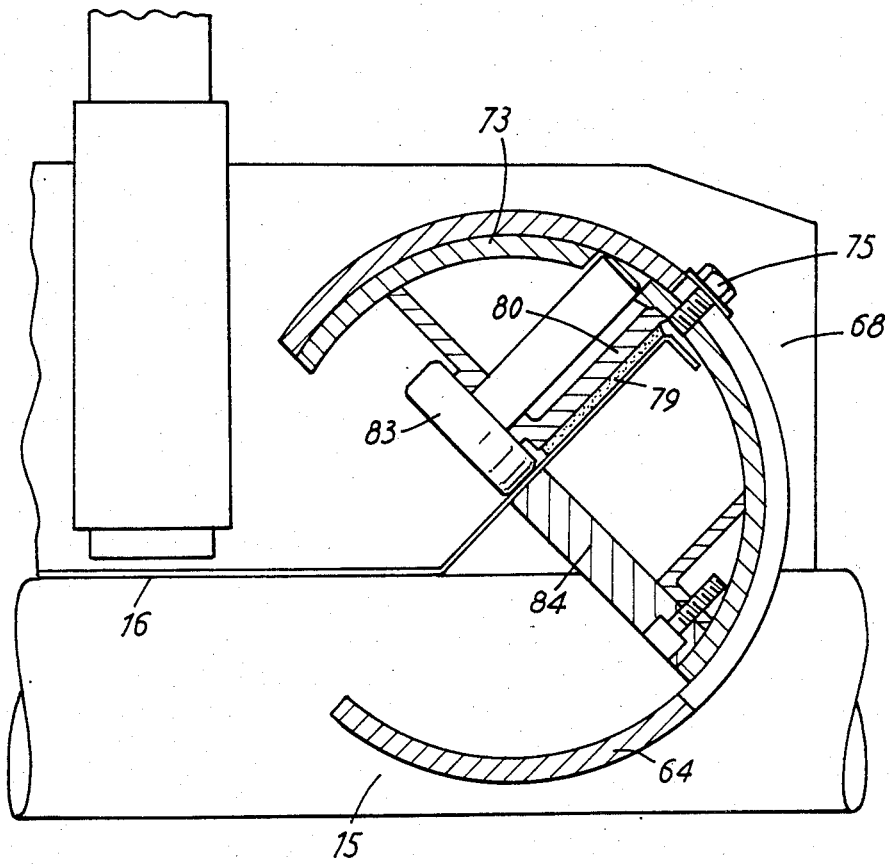

FIG. 7 of the drawing illustrates apparatus provided at Station No. 8 of the machine but shows the apparatus at the right hand side of the machine. This apparatus is designed to form a bend which turns the extreme edge portion of the strip downward towards the supporting rollers 15. The apparatus is similar to that provided at Station No. 7 and corresponding components are indicated by corresponding reference numerals, a desired number of carriages (e.g. 4 or 5) being spaced apart along the length of a common support tube. However, in each carrier, instead of the edge part of the strip being nipped between two rolls as at Station No. 7 the strip is nipped between a roll 83 and the cylindrically curved edge surface of a stationary plate 84 which acts as an anvil member fixed to the internal surface of the carrier. The bottom face of the roll 83 and the stationary plate extend in a diametral plane of the support tube and engage the strip at the center of curvature of the support tube and carrier member and thus define the line at which the bend is to be formed. In FIG. 7 the right hand marginal portion of the strip is shown as being inclined upward at an angle of 45° to the central portion of the strip to make the strip of channel form. The extreme edge part of the strip has been turned outward through an angle of 90° at Station No. 7, and in Station No. 8 a further bend is to be formed which will result in the edge part of the strip being directed towards the plane of the base of the channel. Successive carriers are thus set at an angle of 22½°, 45°, 67½° and 90° from the position shown, assuming that there are four carriers at the station.

It will be understood that at Stations Nos. 7 and 8 the leading edge of the strip will strike the curved surface of a roll or of the plate 84 and will be deflected into the nip to commence the forming process. Since the strip is deflected through 22½° between the nips of successive rolls 83 and their associated plates 84, the edge of each plate 84 downstream of the nip is relieved by being cut away at an increasing angle to prevent interference between the plate and the strip.

The machine incorporates adjacent its inlet end and upstream of the first driving rollers a cutter operable to cut across the strip. In a preferred form the cutter comprises a fixed cutting blade extending under the full width of the maximum width of strip which the machine will accept (including the cut-off strip), and a co-operating cutter disc which is mounted to be traversed along the blade from above the strip. The disc may be hand-operated. The machine is stopped to enable the length of strip which is being formed to be cut across, and the machine is then re-started to complete the forming opeation on the trailing end portion still in the machine. Waste of material can thus be minimized.

If desired, one or both of the edge flange portions of the channel-section forming may be crimped by passing them through pairs of crimping rollers.

In cases where lengthwise ribs are desired, for example for stiffening purposes, it is preferred to form the ribs while the strip is in a flat condition, and the ribs may be formed by a conventional roll-forming operation using co-operating ribbed and grooved rollers. These rollers can conveniently be manually adjusted lengthwise of their driving shafts to position them appropriately.

It will be understood that the operation of the machine including the settings of the roll-forming means at the various stations can be controlled by means of a computer.

In a modified arrangement of the apparatus shown in FIGS. 1 to 6, the roll forming means shown in FIG. 6 is disposed between Stations Nos. 3 and 4 instead of after Station No. 6, and the roll forming means shown in FIG. 7 is disposed between Stations Nos. 5 and 6 instead of after Station No. 7. It will be understood that by altering the relative disposition of the Stations, for example as just described, it may be possible to roll-form sections that would otherwise be outside the size limits with which the apparatus is capable of dealing. Where the overall length of the machine does not permit optional insertion of a station between two other stations, for example in the manner just described, the roll-forming means in FIGS. 6 and 7 may be mountable above their optional positions and lowered into an operational position after the forming means at the station has been moved to an inoperative position, e.g. laterally away from the center-line.

At the delivery end of the machine there is preferably mounted a saw or shearing device which is operable to part the workpiece longitudinally. This considerably increases the flexibility of the apparatus. It is extremely difficult to form a workpiece of V-section because the deforming forces are unbalanced and tend to move the workpiece sideways, but by forming a channel and then splitting the channel longitudinally along its base, two such V-section pieces are formed.

A modified arrangement for producing a top edge portion of more complex shape is shown in FIGS. 9 to 12. The four sets of rollers are mounted in respective part-cylindrical carriers 73*a* to 73*d* which are in turn mounted end-to-end in a common support tube 64 which is adjustable vertically, horizontally and rotationally about its own longitudinal axis in a similar manner to that shown in FIGS. 6 and 7. The carriers 73*a* to 73*d* are independently rotationally adjustable about the longitudinal axis of support tube 64. At each of the four stages in FIGS. 9 to 12 the point at which the deformation commences in the section of the gutter or channel is arranged on the common longitudinal axis of tube 64 and carriers 73*a* to 73*d*.

Figure 9:
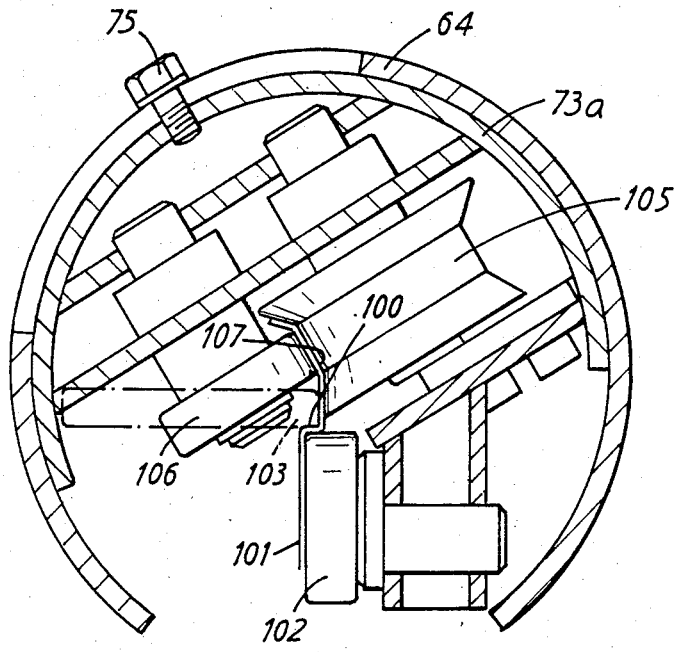
FIGS. 9–12 show a modified arrangement of the forming device of the invention for producing a marginal edge portion of more complex shape.

Referring to FIG. 9 the joggle or shoulder 100 in the marginal portion of the workpiece 101 is formed before the stage at which the workpiece commences to be formed into a channel and carried out by a conventional roller arrangement. In FIG. 9 the shoulder is engaged by a roller 102 and by a side face of a plate 103 which are mounted in a carrier 73*a* and which serve to locate the marginal portion of the workpiece, a curved face of plate 103 engaging the workpiece on its inner face beyond the shoulder. The final shape in this first stage is determined by a channel-profiled roller 105 and a plain roller 106 having an axial length equal to the width of the base of the channel profile of roller 105. The deformation of the marginal portion of the workpiece in this stage commences at the lower edge 107 of the base of the channel as it is shown in FIG. 9 and this point in the profile of the workpiece is accordingly arranged on the common longitudinal axis of carrier 73*a* and tube 64.

Figure 10:
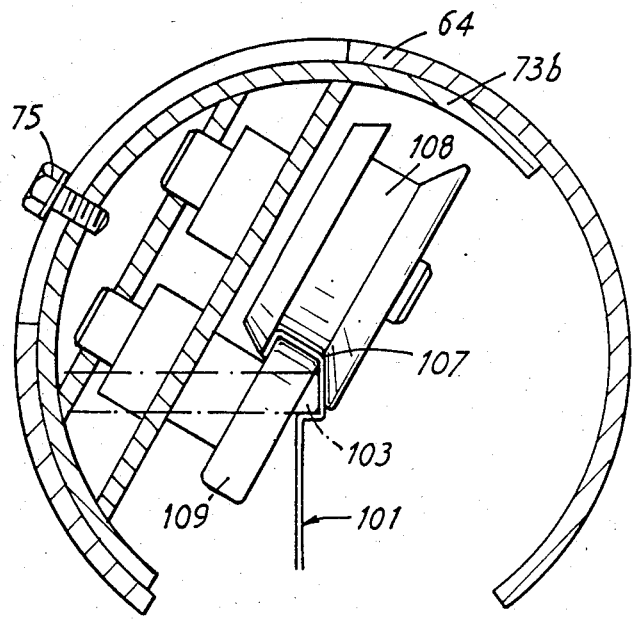
Figure 11:
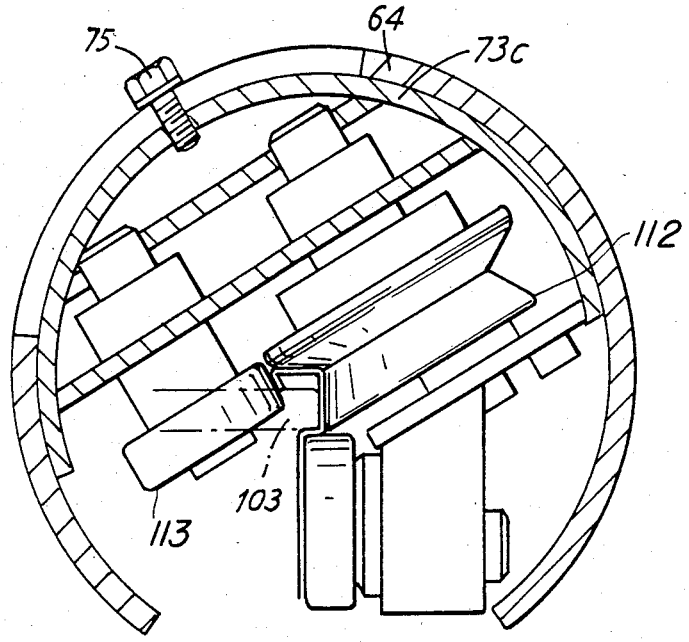
Figure 12:
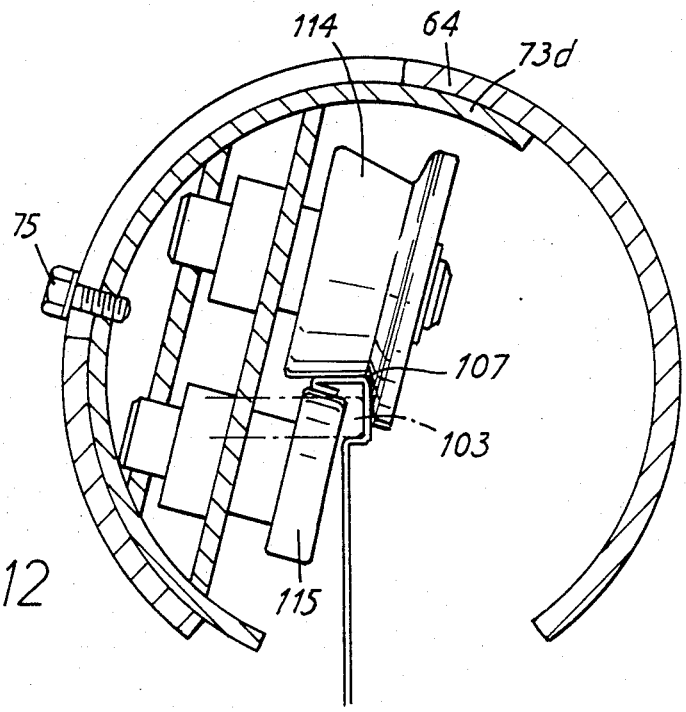

At the next stage, illustrated in FIG. 10, the angles between the base and the two side walls respectively of the channel profile are reduced by a further channel profiled roller 108 and co-operating plain roller 109, the carrier 73*b* being appropriately angularly positioned within the support tube 64. In the carrier 73*c* a further channel-profiled roller 112 and plain roller 113 are mounted which reduce the two angles again and commence to form a seamed edge on the workpiece. This seamed edge is further developed in the final stage shown in FIG. 12 by a fourth channel-profiled roller 114 and co-operating plain roller 115 mounted in the carrier 73*d* which is appropriately rotationally positioned within the support tube 64.

Each of the carriers 73*b* to 73*d* has fixedly mounted in it a plate 103, a curved edge of which engages the inner face of the workpiece above the shoulder 100 so as accurately to locate the workpiece throughout these stages of shaping its marginal portion.

Where it is required to produce a section having a wide side flange, with a profiled edge, along one side or both sides of the section, the machine may be provided at each side with a forming device as shown in FIGS. 13 to 20.

Figure 13:
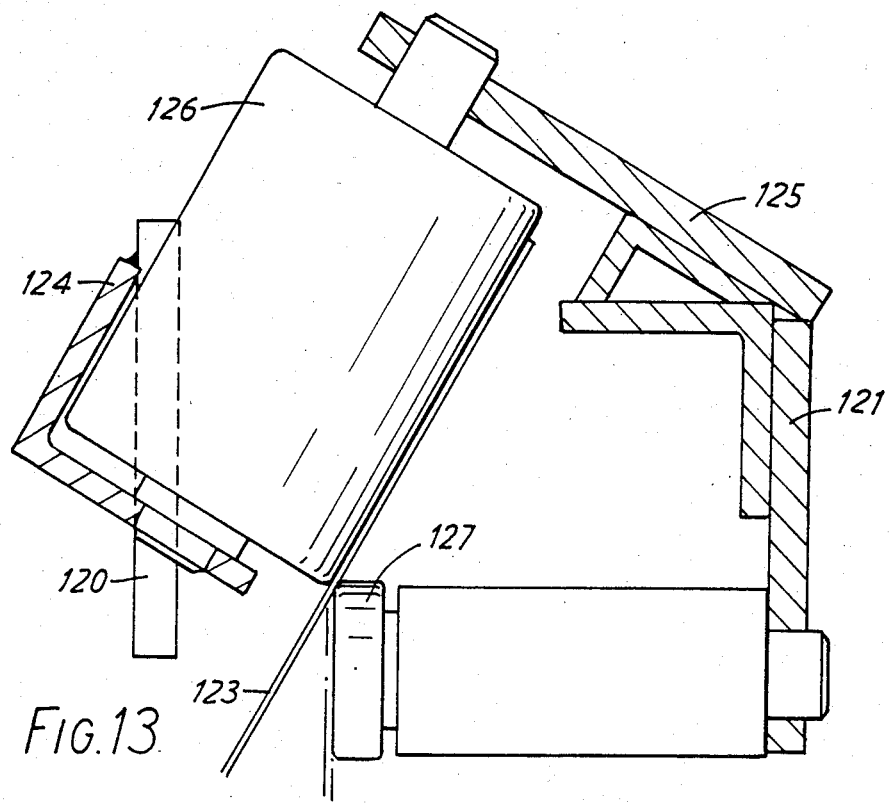
FIGS. 13–20 show a modified arrangement of the forming device of the invention for producing a section with a wide side flange.
Figure 14:
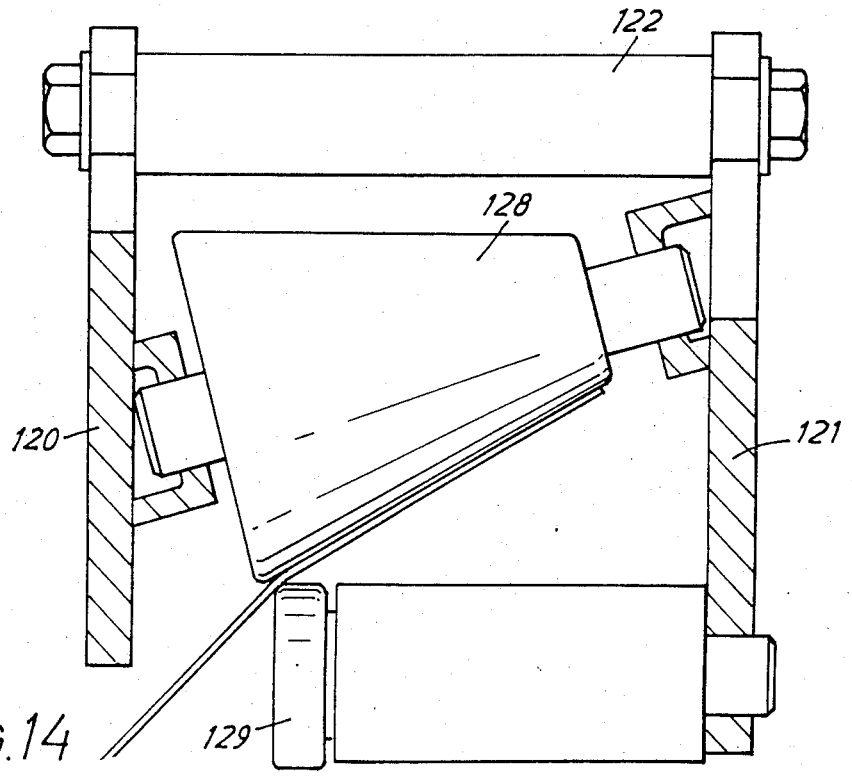
Figure 15:
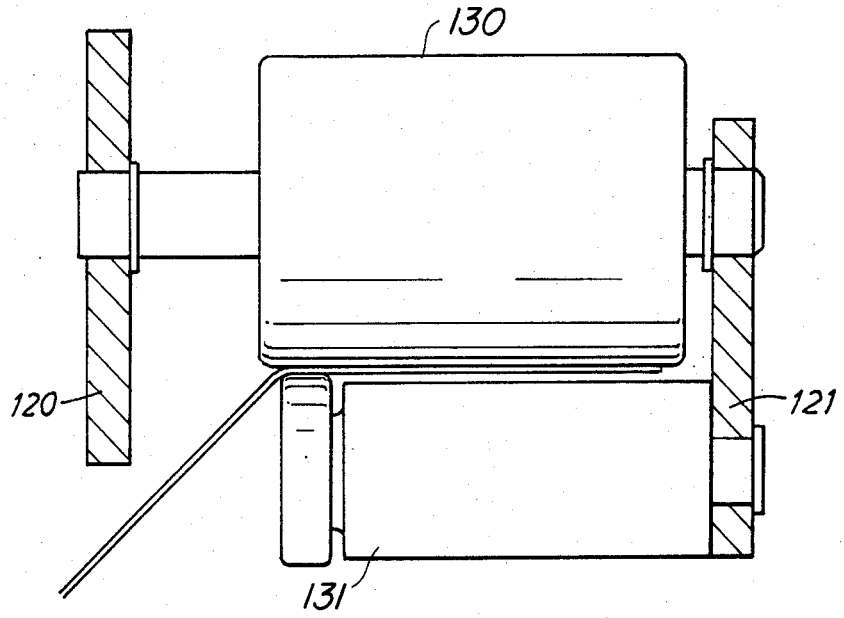

The forming device comprises a main frame comprising two upright side plates 120, 121 extending in the direction of movement of the workpiece through the machine and rigidly interconnected by horizontal bars 122. This main frame is movable upward and downward towards and away from the longitudinal centre-line of the machine for the purpose of adjusting the position at which the side flange commences. FIGS. 13, 14 and 15 show respectively three sets of rollers which progressively bend into a horizontal position the upwardly inclined side edge portion 123 of a channel-section element. In FIG. 13, a locating roller 126 mounted on brackets 124, 125 secured to plates 120, 121 presses the portion 123 of the workpiece against a corner of a roller 127. The workpiece passes then to the next station, illustrated in FIG. 14, where the marginal part of the workpiece is bent downward and outward by a roller 128 about the corner of a co-operating roller 129. Roller 128 in this construction is of conical form but may be cylindrical if desired. From rollers 128, 129 the workpiece passes between rollers 130, 131 shown in FIG. 15 which complete the deformation of the marginal portion into a horizontal position. The workpiece then passes to the next station, shown in FIG. 16, at which is disposed one end portion of a sub-frame which is carried by the side plates 120, 121 but is adjustable in a direction towards and away from the longitudinal centre-line of the machine relative to plates 120, 121. The sub-frame arrangement, which can best be understood from FIGS. 18 and 19, comprises a rigid vertically disposed plate 135 to the inner face of which threaded nuts 136 are welded at spaced locations.

Figure 16:
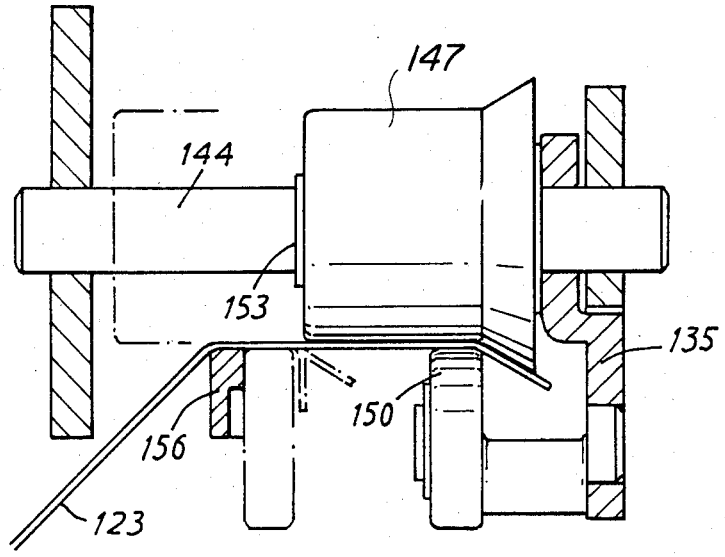
Figure 17:
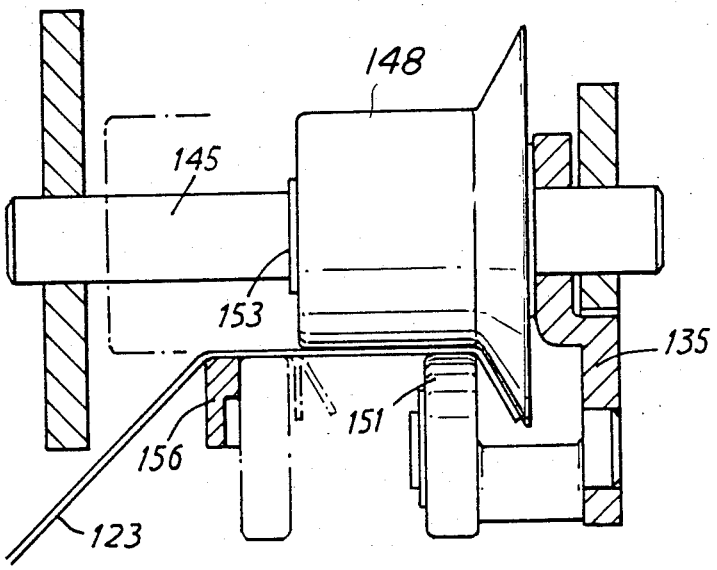
Figure 18:
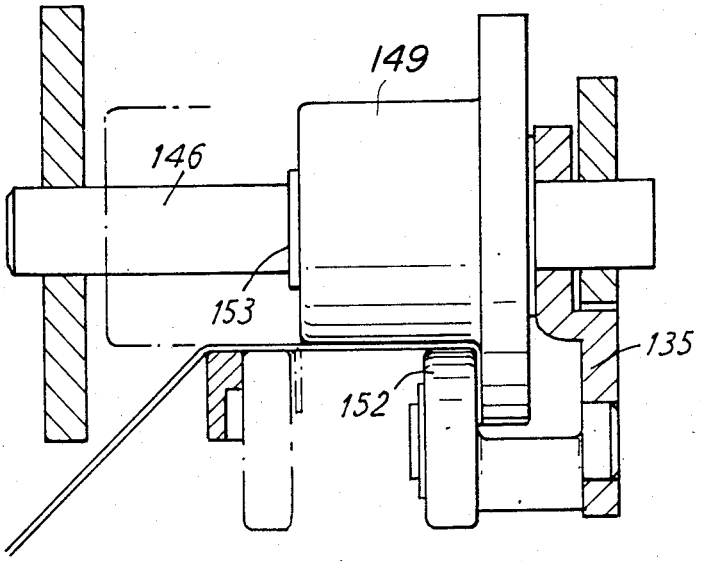
Figure 19:
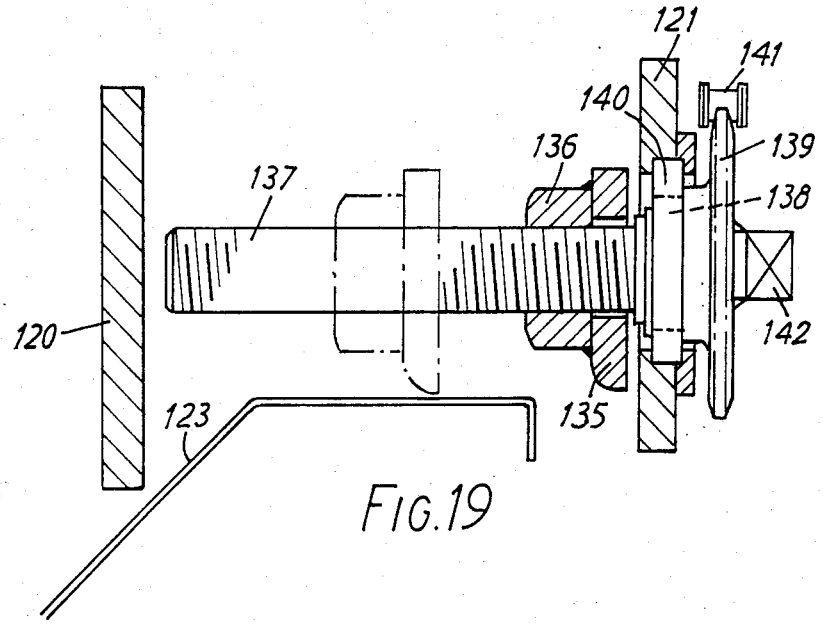

A lead screw 137 extends through and engages in each nut 136, through an aperture in plate 135 and has fixed on its outer end portion the boss 138 of a chain sprocket 139 carried in a bearing 140 in side plate 121. A chain 141 extends about all the sprockets 139. The outer end 142 of the lead-screw is square to enable it to be rotated. The sprockets and chain thus ensuring that all the lead screws rotate simultaneously and to the same extent to traverse the nuts 136 and plate 135 laterally of the machine relative to the side plates 120, 121. Shafts 144, 145, 146 shown in FIGS. 16, 17 and 18 are connected to plate 135 and are slidably engaged in plates 120, 121, and respectively carry forming rollers 147, 148, 149 respectively which serve progressively to deform the edge portion of the workpiece into a vertically downward attitude about respective co-operating rollers 150, 151, 152. The forming rollers have one end abutting plate 13*b* and have their other ends engaged by circlips 153 on the shafts, so that the forming rollers are constrained to move with plate 135, enabling the lateral position of turning down of the edge of the workpiece to be adjusted.

Figure 20:
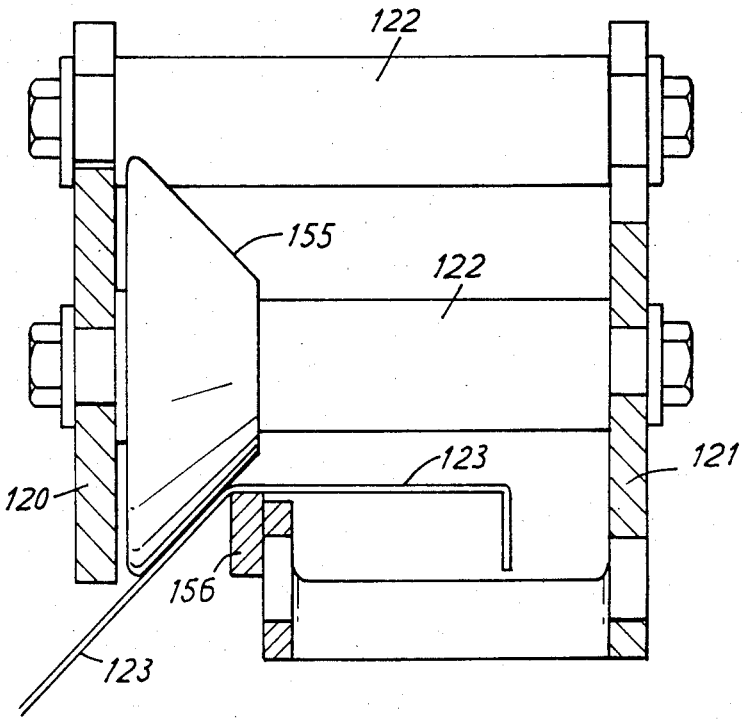

FIG. 20 shows a conical guide roll 155 which is rotatably mounted on one of the bars 122 at the downstream end of this forming device and which serves to press the workpiece against a rigid bar 156 supported by side plate 121 to locate the workpiece. The bar 156 extends upstream to the station shown in FIG. 16.

I claim:

1. Roll forming apparatus, comprising:

a main frame;

means, mounted on said main frame and extending in a lengthwise direction, for supporting a strip of sheet metal which moves from an upstream direction to a downstream direction;

a first frame component attached to said main frame and extending in said lengthwise direction, means for adjustably positioning said first frame component in directions at right angles to said lengthwise direction;

driving means, mounted on said first frame component, for driving said strip of sheet metal in said lengthwise direction through said roll forming apparatus, said driving means including a plurality of pairs of rolls, located at intervals spaced along said first frame component in said lengthwise direction, and jointly defining a plane of nipping of said strip of sheet metal, the rolls at one side of said plane having corresponding edges thereof aligned in said lengthwise direction to define a bending axis of said strip of sheet metal;

a plurality of bars mounted on said first frame component at positions laterally offset from said bending axis and extending in said lengthwise direction and ending at a position along said first frame component, said plurality of bars being inclined at an angle with respect to said support means and being operable to engage and progressively bend a marginal portion of said strip of sheet metal about said bending axis, at least one of the rolls at the other side of said plane being formed with a portion beyond said bending axis which portion has a chamfered surface extending laterally away from said axis towards said bars;

at least one forming means, located downstream of said plurality of bars along said lengthwise direction, said at least one forming means including a bearing sleeve mounted on said first frame component and having a wide axially-extending slot therein, said bearing sleeve having an arcuate bearing surface extending about a second axis which is laterally offset from and parallel to said bending axis, a carrier mounted within and adjustably secured to said bearing sleeve to fix said carrier in a predetermined angular position about said second axis, a first roller mounted on said carrier for rotation about a third axis which extends in a plane which is perpendicular to said second axis, and anvil member means mounted on said carrier for engaging said marginal portion of said strip of sheet metal between said first roller mounted on said carrier and said anvil member means.

2. The apparatus of claim 1, wherein said anvil member means comprises a second roller mounted on said carrier for rotation about a fourth axis which is parallel to said third axis.

3. The apparatus of claim 2, wherein said third axis is located on one side of a plane passing diametrically through said second axis and said fourth axis is located on the other side of said plane passing diametrically through said second axis.

4. The apparatus of claim 2, wherein said first and second rollers each have an axial end face, said axial end faces being coplanar in a plane containing said second axis.

5. The apparatus of claim 1, wherein said first roller has a cylindrical peripheral surface, an axial edge of which is tangential to said second axis.

6. The apparatus of claim 2, wherein said second roller is a channel profiled roller.

7. The apparatus of claim 1, wherein means is provided for adjusting said angle of inclination of said plurality of bars, said means comprising:

arms rotatably mounted on said first frame component and attached to said plurality of bars for pivoting said plurality of bars about said bending axis;

a slide movably mounted on said first frame component for sliding movement towards and away from said bending axis;

an abutment member fixedly attached to said slide and positioned to abut at least one of said plurality of bars for adjusting said angle of inclination of said bars;

a rack movably mounted on said first frame component in a direction parallel to said bending axis;

cam means fixedly attached to said rack and having a cam surface which is at an angle to said bending axis and in contact with said slide for urging said slide towards and away from said bending axis; and a pinion rotatably mounted on said first frame component and engaged with said rack for moving said rack parallel to said bending axis, whereby said angle of inclination of said plurality of bars is adjusted by rotating said pinion to move said rack and cam surface parallel to said bending axis which moves said slide and abutment member towards or away from said bending axis to thereby pivot said plurality of bars mounted on said arms.

8. The apparatus of claim 1, wherein said main frame includes a second frame component extending parallel to said first frame component, said second frame component having driving means for driving said strip of sheet metal in said lengthwise direction, a plurality of bars which are adjustably inclined with respect to a second bending axis parallel to and laterally offset from said first bending axis and forming means for engaging the other lengthwise extending marginal portion of said strip of sheet metal, said second frame component being located opposite to and being a mirror image of said first frame component.

9. The aparatus of claim 8, wherein said roll forming apparatus includes means mounted on said main frame for independently moving said first and second frame components towards and away from each other.

* * * * *